US005867073A

United States Patent [19]

Weinreb et al.

[11] Patent Number: 5,867,073

[45] Date of Patent: Feb. 2, 1999

[54] WAVEGUIDE TO TRANSMISSION LINE TRANSITION

[75] Inventors: Sander Weinreb, Columbia, Md.; Dean N. Bowyer, Maitland, Fla.

[73] Assignee: Martin Marietta Corporation, Bethesda, Md.

[21] Appl. No.: 286,982

[22] Filed: Jun. 8, 1994

Related U.S. Application Data

[63] Continuation of Ser. No. 876,993, May 1, 1992, abandoned.

[51] Int. Cl.[6] ..... H01P 5/107

[52] U.S. Cl. ..... 333/26; 333/33

[58] Field of Search ..... 333/26, 33

[56] References Cited

U.S. PATENT DOCUMENTS

| | | | |
|---|---|---|---|
| 2,829,348 | 4/1958 | Kostriza et al. | 333/26 |
| 2,877,429 | 3/1959 | Sommers et al. | 333/24 R |
| 3,093,805 | 6/1963 | Osifchin et al. | 333/238 X |
| 3,924,204 | 12/1975 | Fache et al. | 333/21 R |
| 4,544,902 | 10/1985 | Harris | 333/250 |
| 4,716,386 | 12/1987 | Lait | 333/26 |
| 4,725,793 | 2/1988 | Igarashi | 333/26 |
| 4,851,794 | 7/1989 | Williams et al. | 333/33 |
| 5,017,892 | 5/1991 | Dalman | 331/96 |

FOREIGN PATENT DOCUMENTS

| | | | |
|---|---|---|---|
| 2462787 | 3/1981 | France | 333/26 |
| 3738262 | 5/1989 | Germany . | |
| 75002 | 5/1982 | Japan | 333/26 |
| 2402 | 1/1984 | Japan | 333/26 |
| 92402 | 1/1985 | Japan | 333/26 |
| 17502 | 1/1989 | Japan | 333/33 |

OTHER PUBLICATIONS

"A New Rectangular Waveguide to Coplanar Waveguide Transition", Report No. NASA TM–102477, Jan. 1990, George E. Ponchak and Rainee N. Simons, pp. 1, 2 and Report Documentation Page.

"A New W–Band Coplanar Waveguide Test Fixture", Bellantoni, Compton and Levy, 1989 IEEE MTT–S Digest (PP–22), pp. 1203, 1024.

"New Waveguide–to–Coplanar Waveguide Transition for Centimetre and Millimetre Wave Applications", Electronics Letters, 21st Jun. 1990, vol. 26, No. 13, pp. 830, 831.

"Propagation Modes and Dispersion Characteristics of Coplanar Waveguides", IEEE Transactions on Microwave Theory and Techniques, vol. 38, No. 3, Mar. 1990 (New York, US).

*Primary Examiner*—Benny T. Lee

*Attorney, Agent, or Firm*—Gay Chin; William H. Meise

[57] ABSTRACT

A transition between a waveguide and transmission line is disclosed in which a probe portion of the transmission line extends into the waveguide to electrically field couple signals between the waveguide and transmission line. The transmission line is preferably a coplanar fuse and includes a substrate having conductors disposed therein which prevent energy from propagating into the substrate from the waveguide. Propagation of energy into the desired transmission line mode is therefore facilitated. Because the probe is formed as an integral part of the transmission line, direct coupling to the waveguide is possible without the use of intervening sections, transitions or transmission lines. The transition may be scaled in order to couple a wide range of frequencies.

6 Claims, 2 Drawing Sheets

WAVEGUIDE TO TRANSMISSION LINE TRANSITION

This application is a continuation of Ser. No. 07/876,993, filed May 1, 1992, now abandoned.

BACKGROUND OF THE INVENTION

The present invention relates to a waveguide to transmission line transition for coupling signals between transmission lines and waveguides. Such transitions are commonly used for transmission of microwave and millimeter wave energy. Microwave and millimeter wave energy can be transmitted through a number of different transmission media, including waveguides, microstrip and coplanar transmission lines and coaxial cables. Often times, it is necessary to interface one type of transmission medium with another. For instance, coplanar transmission lines are well suited for the transmission of energy on the surface of a semiconductor integrated circuit, while waveguides are suitable for transmission of energy over larger distances. Thus, a need for a transition between the two media arises.

Conventional transitions and adaptors can be configured in the form of fins, ridges and steps disposed in a waveguide. The ridges, fins, and steps are physically designed to transform the impedance of the waveguide to match that of the transmission line. The structures guide microwaves or millimeter waves from a waveguide into an interface, such as a microstrip transmission line. The performance of transitions with these elements depends critically on the dimensions of the elements. Often, fins and ridges are difficult to manufacture.

Conventionally, coplanar waveguide and microstrip transmission lines have been coupled to waveguides by means of intervening transmission lines such as coaxial lines or finlines. The present invention avoids these intermediate transmission lines and has the advantages of lower fabrication cost, lower reflections, and increased reliability due to the elimination of very small and delicate connections in the case of small wavelength devices, e.g., millimeter wavelengths.

Harris, U.S. Pat. No. 4,544,902 shows a semiconductor probe coupling a coaxial cable to a rectangular waveguide. The reference describes a rectangular waveguide, a coaxial cable, a probe and a connector. A semi-conductor probe from the coaxial connector protrudes through a waveguide wall and is connected to the opposite wall of the waveguide.

Igarashi, U.S. Pat. No. 4,725,793 describes a waveguide to microstrip converter in which a probe is formed, surrounded by a dielectric to keep it structurally stable, in a short circuit waveguide. A microstrip transmission line is formed on a substrate. An end of the probe, which is not on the same substrate as the microstrip transmission line, is connected by soldering to the microstrip line.

Fache et al, U.S. Pat. No. 3,924,204 describes a waveguide to microstrip converter in which a microstrip transmission line penetrates into a waveguide through a slot. The transmission line includes a substrate with a conductor strip disposed thereon. The substrate enters the waveguide approximately one-quarter wave from the short circuit plane of the waveguide. In one embodiment, the substrate apparently extends through the waveguide. The substrate of the probe is positioned in the waveguide so that the plane of the substrate is parallel to the length of the waveguide.

Kostriza et al, U.S. Pat. No. 2,829,348 describes a coupling between a transmission line and a rectangular waveguide. The transmission line could be of a type that comprises a ground planar conductor, a layer of dielectric material, and a line conductor. The transmission line is coupled by extending the line conductor through a slot into the rectangular waveguide. The conductor and dielectric can extend partially or entirely across the waveguide. The probe and transmission line are disposed on the same substrate.

Ponchak and Simons, NASA TM-102477, January 1990 describe a rectangular waveguide to coplanar waveguide transition. A sloping tapered ridge in a top broad wall of the rectangular waveguide protrudes and extends down to contact a groove-like slot which gradually tapers in the bottom wall of the rectangular waveguide. The bottom wall can be formed by a printed circuit board.

Dalman, U.S. Pat. No. 5,017,892 & Cornell University Electronics Letters 21 June 1990, show a microwave waveguide to coplanar transmission line transition made of metal. The top wall of the waveguide is an integral part of the output coplanar waveguide, or coplanar transmission line. A signal entering the waveguide encounters a centrally located tapered fin which is shaped to gradually guide the wave to a slot formed in the top of the waveguide. The fin slopes in such a manner as to become the center conductor of the coplanar transmission line. The sidewalls of the slot provide separate ground planes.

Bellantoni, IEEE 1989 Cornell University, shows a transition from waveguide to coplanar transmission line comprising a test fixture employing a sloping finline.

Prior art devices that use sloping fins are difficult to manufacture to the precise tolerances required for optimum performance and are difficult to position within a waveguide. Microwave transitions are complicated by intervening transmission and adaptor structures imposed between the waveguide and transmission line which can create unwanted reflections.

SUMMARY OF THE INVENTION

It is therefore an object of the present invention to provide a novel waveguide to transmission line transition.

It is another object to provide a transition which is easy to fabricate to precise tolerances and that provides low reflection, broad band interfacing and minimal moding.

It is a further object of the present invention to provide a waveguide to transmission line transition having a probe that is easier to position within the waveguide than sloping or fin shaped probes.

It is yet another object of the present invention to provide a transition without intervening transmission lines between the waveguide and transmission line. This is accomplished in one embodiment of the invention by forming the probe circuit and the transmission line circuit on the same substrate.

It is still another object of the present invention to provide a transition between waveguide and transmission line in which the transmission line includes first and second ground plates disposed on opposite sides of a substrate which are connected by conductors formed through the substrate. These conductors substantially eliminate electric signal energy dissipation into the substrate to reduce energy loss. The connectors, or via holes, short out the electric field of the substrate so that the signal only propagates on the center conductor. The substrate partially protrudes through a slot in the wall of a waveguide and couples energy with minimum reflection between the waveguide and the transmission line on the substrate. In a typical application the substrate is gallium-arsenide and the flat strip conductors are gold. The additional conductors are preferably gold and are termed "via holes" or "plated-through holes".

DESCRIPTION OF THE PREFERRED EMBODIMENT

The present invention relates to a transition from a waveguide to a transmission line. A waveguide is a transmission medium that guides signals in the form of electromagnetic radiation. The waveguide is typically a hollow metallic pipe, usually with no material inside. In a preferred embodiment, the metal might be copper or aluminum. The waveguide can be rectangular, square, circular, cylindrical, ridged, elliptical, or any other suitable configuration. The invention is preferably embodied as a transition between a waveguide and coplanar waveguide or transmission line because there is less energy dissipation into the substrate of a coplanar transmission line. It will be understood that the terms "coplanar waveguide" and "coplanar transmission line" are used interchangeably in this application. Further, coplanar transmission lines are more preferred than microstrip transmission lines for use in millimeter wave integrated circuits because of their lower ground inductance, ease of surface probe testing, and accommodation of a thicker and less fragile substrate. However, the use of microstrip transmission lines may be useful in certain applications and is considered to be within the scope of the present invention.

Figure 1:
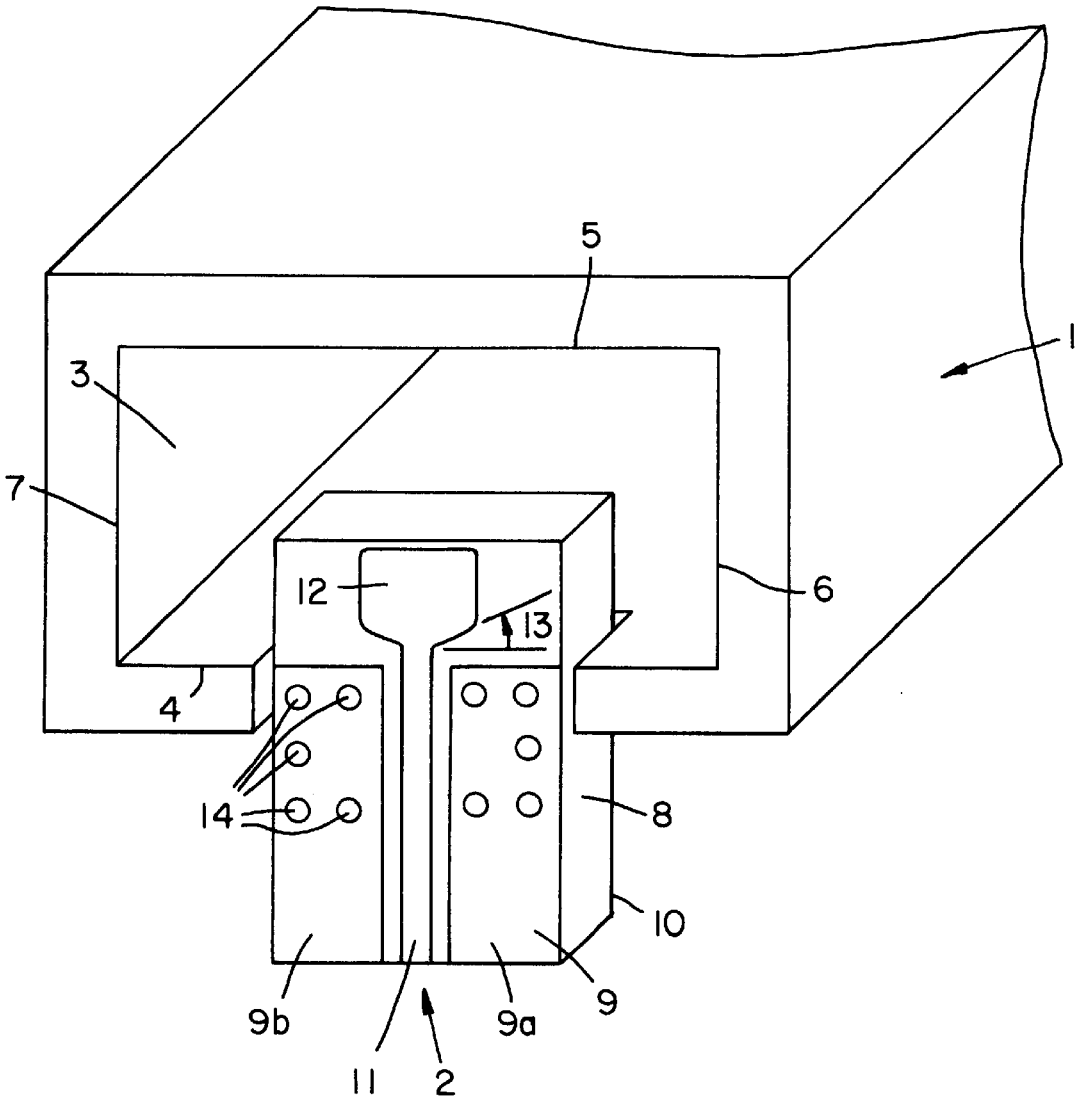
FIG. 1 is an isometric view of a waveguide to coplanar transition in accordance with one embodiment of the present invention.

Referring to FIG. 1, the transition couples the dominant mode in a hollow, metallic, waveguide 1 to a transmission line 2. The waveguide is formed to define an interior volume 3 with open endfaces, to receive and deliver the signal. In a preferred embodiment using a rectangular waveguide, there are four walls including a first wall, a second wall, a third wall, and a fourth wall, 4, 5, 6, and 7 respectively.

A substrate 8 has a first ground plate 9 in the form of a metallic coating that serves as a ground plane. In a preferred embodiment, the substrate 8 is GaAs doped to a dielectric constant of $\epsilon r=13$. Alternatively, the substrate could be any dielectric such as polystyrene, alumina or TEFLON synthetic resin polymer. A second ground plate 10, which is a metallic coating, covers the entire reverse side of the substrate 8 except within the rectangular waveguide 1. The second ground plate 10 acts as another ground plane. Two separated metalization layers i.e., the first metalization layer 9*a* and the second metalization layer 9*b*, are formed on the first ground plate 9. A printed metallic line 11 on the substrate 8 in the center between the first metalization layer 9*a* and the second metalization layer 9*b* is the conductor of the transmission line that is isolated from the layers 9*a*, 9*b* at least for d.c. The portion of the printed metallic line 11 that extends into the waveguide 1 is considered the transition probe 12. The shape and width of probe 12 can be varied. The probe has a taper angle 13 measured from a base perpendicular to the metallic line 11. Probe 12 couples electric signals between waveguide 1 and transmission line 2. Because the metalization of ground plate 10 is removed within the waveguide, the probe 12 is not shielded by the ground plane. This ensures coupling between the coplanar line and the waveguide.

Conductors 14 in the form of cylindrical metallic pins electrically connect the first ground plate 9 and the second ground plate 10 through the substrate 8. They are known as "via holes" or "plated-through holes" and are formed through the substrate close to the inside wall of the waveguide. This short circuits the electric field of dielectric modes to thereby achieve propagation of energy into the coplanar mode. Although coplanar lines are susceptible to less spurious energy dissipation into the substrate than microstrip transmission line, there is still some tendency for the energy from the waveguide to propagate within the substrate. This increases insertion loss which includes power lost in reflections between the waveguide and transmission line, ordinary impedance loss in electrical conductors, and the loss of power into the substrate which comprises the transmission line. Insertion loss is measured as the output power, measured under the center conductor, divided by the input power into the waveguide. The electrical conductors 14 are preferably formed through the substrate parallel to the electric field of electromagnetic radiation with the substrate. In Maxwell's equation, the electric field is zero measured parallel to a conducting surface. Thus, the additional conductors reflect the signal energy away from the substrate so that less energy is lost from propagation into the substrate. As a result, the signal only propagates on the center conductor in the desired transmission line mode. The conductors 14 are formed close to the end of the portion of the substrate 8 that is not in the waveguide. It was empirically determined that a maximum spacing of 0.2 wavelengths between vias would minimize the loss of signal energy into the substrate.

The transition functions by coupling the electric field in the waveguide 1 to the probe 12 of the transmission line extending into the waveguide. The via holes significantly improve operation by preventing the propagation of energy into the substrate. Without the conductors 14, this energy would be lost e.g., by going off in spurious directions or by being reflected back into the rectangular waveguide.

It is noted that in FIG. 1 the width of the substrate 8 extending into the waveguide 1 is less than the width of the waveguide 1. Alternatively, the portion of the substrate 8 inside the waveguide 1 may have a width equal to the full waveguide width. It has empirically been found that ultimate performance is relatively insensitive to probe and substrate width.

It is possible to change the transition dimensions, depending on the frequencies to be coupled, and dielectric constant of the transition. The shape of the probe, specifically the angle 13 of the taper, was found to have an effect on the bandwidth of the transition. A large taper angle 13 yields an excellent return loss over a narrow frequency range, while a smaller taper angle 13 increases the bandwidth but at the expense of return loss.

There may be additional transmission lines and circuit elements such as transistors, diodes, resistors, inductors, and capacitors connected to the coplanar transmission line. These do not affect the operation of the transition provided they are not within one-half wavelength of the waveguide. The waveguide would usually extend in the direction of the viewer of FIG. 1 and would be terminated with a short circuit at a distance of approximately one-quarter wavelength from the substrate's point of entry into the waveguide.

Figure 2:
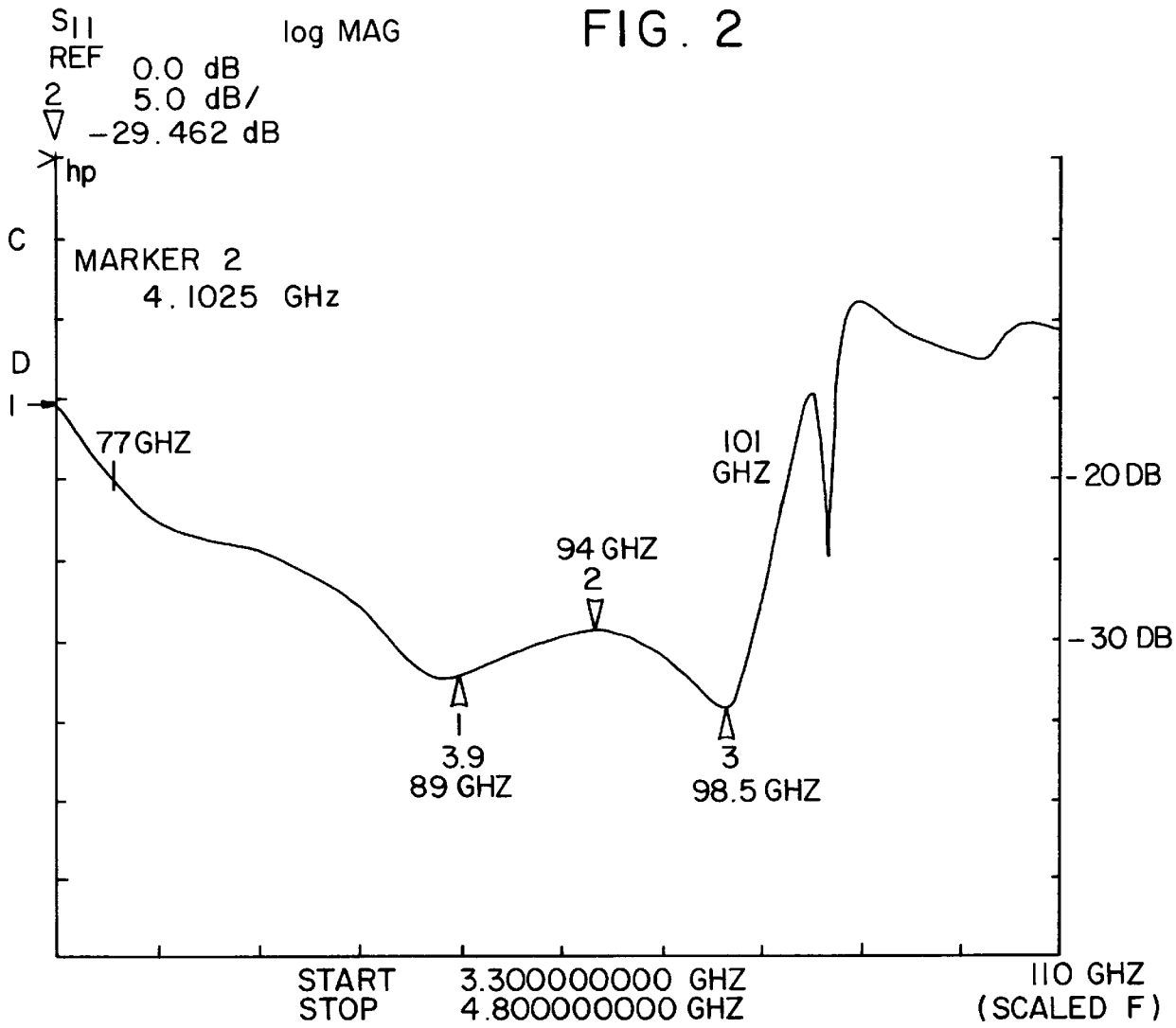
FIG. 2 shows the measured reflection coefficient versus frequency of a scale model of the present invention.

A working scale model of the transition similar to that shown in FIG. 1 was constructed and tested with the results shown in FIG. 2. The model has all dimensions 22.9 times the size of a typical millimeter-wave version of the transition and then gives identical performance at 1/22.9 times the millimeter-wave frequency in accordance with well accepted scaling laws for electromagnetic waves. FIG. 2 shows the transition's reflection coefficient in dB for frequencies between 3.3 GHz and 4.8 GHz. As described above, that range scales to about 76–110 GHz. The transition gave less than 1% reflected power over the 3.36 GHz to 4.41 GHz frequency range. A transition 22.9 times smaller would give this performance from 77 to 101 GHz. A short circuit was placed in the waveguide and a reflection coefficient close to unity was measured in the coplanar waveguide. This verifies that the transition does not radiate or couple into the dielectric substrate.

A preferred embodiment of the invention has been described in the form of a rectangular waveguide to coplanar transmission line transition. Instead, the waveguide may be elliptical, circular, cylindrical, ridged, square, etc. The transmission line may be microstrip rather than coplanar. Although dimensions of a preferred embodiment of the present invention have been described, the dimensions can be proportionally scaled for use with different frequencies of electric signals to be coupled.

It is to be understood that the above description of the present invention is susceptible to various modifications, changes, and adaptations by those skilled in the art, and that such are to be considered to be within the spirit and scope of the invention as set forth by the following claims.

What is claimed is:

1. A transition between waveguide and transmission line, comprising:

a waveguide defining an internal volume;

a transmission line including a coplanar waveguide comprising a substrate having a probe disposed on a side surface thereof, and having a first ground plane including two metallization portions disposed on the substrate on the same side surface as the probe and a conductive metal line coplanar with said two metallization portions, and which is connected to the probe and is separately disposed between the two metallization portions, said transmission line including a second ground plane disposed on a side surface of the substrate opposite the side surface where said probe is disposed, wherein the coplanar waveguide is disposed with respect to the waveguide such that only the probe extends into the internal volume of the waveguide, and said second ground plane does not extend into the internal volume of said waveguide, and the substrate comprises gallium arsenide; and conductive means disposed within the substrate for substantially preventing energy propagation from the waveguide and the coplanar waveguide into the substrate;

wherein the probe has a width which is substantially greater than a width associated with the conductive metal line, and the probe is connected to the conductive metal line by a region tapered at an angle from the metal line.

2. A transition, comprising:

a rectangular waveguide including first and second electrically conductive, mutually opposed, parallel, planar broad walls, equally spaced from a longitudinal axis of said waveguide, physically and electrically connected together by mutually opposed narrow walls to define an electrically conductive tube having a rectangular transverse cross-section and an interior region, said first broad wall defining a slot lying in a slot plane transverse to said longitudinal axis of said waveguide;

a planar hybrid microstrip/coplanar transmission line including a planar substrate defining first and second broad surfaces, said substrate comprised of a material having relatively low electrical conductivity, said hybrid transmission line further including a strip conductor extending along said first side of said substrate, and a first ground plane extending over said second side of said substrate and under said strip conductor, whereby said strip conductor coacting with said first ground plane defines a microstrip transmission line, said hybrid transmission line further comprising second and third ground planes disposed on said first side of said substrate coplanar with said strip conductor and equally spaced therefrom, whereby said strip conductor coacting with said second and third ground planes defines a coplanar transmission line, said first, second, and third ground planes terminating at a selected plane transverse to said strip conductor, and said strip conductor, and an associated portion of said substrate, extending beyond said selected plane to thereby define an exposed probe portion of said hybrid transmission line, decoupled from any one of said first, second and third ground planes;

said probe portion of said planar hybrid transmission line lying in said slot plane, and being located so as to extend through said slot in said first broad wall of said rectangular waveguide, said probe portion projects into the interior region of said conductive tube to a depth at which said selected plane is coplanar with the planar first broad wall of said rectangular waveguide, but not so far that said probe portion extends to the planar second broad wall of said rectangular waveguide, whereby said exposed probe portion of said hybrid transmission line provides a transition between said hybrid transmission line and said rectangular waveguide, and said rectangular waveguide is capable of propagation past said slot plane at which said probe is located.

3. A transition according to claim 2, wherein said substrate material is gallium arsenide.

4. A transition according to claim 3, wherein said gallium arsenide is doped so as to have a dielectric constant of $\epsilon_r$=13.

5. A transition according to claim 3, wherein said hybrid transmission line includes conductive pins extending between said first ground plane and said second and third ground planes near said selected plane, for thereby tending to maintain said ground planes at a same potential and to reduce propagation of energy into said substrate in any mode other than a principal mode of said hybrid transmission line.

6. A transition according to claim 3, wherein said probe portion of said strip conductor has a width which is wider than a width associated with said strip conductor in regions of said hybrid transmission line other than said probe portion.

* * * * *